US008801055B2

(12) United States Patent
Muramatsu

(10) Patent No.: US 8,801,055 B2
(45) Date of Patent: Aug. 12, 2014

(54) DOOR LOCK MECHANISM

(75) Inventor: Takahiro Muramatsu, Hamamatsu (JP)

(73) Assignee: Suzuki Motor Corporation, Hamamatsu (JP)

( * ) Notice: Subject to any disclaimer, the term of this patent is extended or adjusted under 35 U.S.C. 154(b) by 340 days.

(21) Appl. No.: 12/943,371

(22) Filed: Nov. 10, 2010

(65) Prior Publication Data

US 2011/0271721 A1 Nov. 10, 2011

(30) Foreign Application Priority Data

Nov. 11, 2009 (JP) ..... 2009-257610

(51) Int. Cl.
*E05B 3/00* (2006.01)
*E05B 65/12* (2006.01)
*E05B 53/00* (2006.01)

(52) U.S. Cl.
CPC ..... *E05B 77/12* (2013.01); *E05B 53/00* (2013.01); *E05B 77/04* (2013.01)
USPC ..... 292/336.3; 70/237

(58) Field of Classification Search
USPC ..... 70/237, 238; 292/210, 216, 336.3, 292/DIG. 23, DIG. 67
See application file for complete search history.

(56) References Cited

U.S. PATENT DOCUMENTS

| | | | | |
|---|---|---|---|---|
| 3,596,482 | A * | 8/1971 | Pollak | 292/216 |
| 5,253,906 | A * | 10/1993 | Rogers et al. | 292/216 |
| 5,308,130 | A * | 5/1994 | Lee | 292/336.3 |
| 5,725,262 | A * | 3/1998 | Kritzler | 292/336.3 |
| 5,934,817 | A * | 8/1999 | Kim et al. | 292/336.3 |
| 5,988,712 | A * | 11/1999 | Segelin | 292/346 |
| 6,240,754 | B1 * | 6/2001 | Petersen | 292/DIG. 23 |
| 6,880,867 | B2 * | 4/2005 | Schoen et al. | 292/216 |
| 7,363,788 | B2 * | 4/2008 | Dimig et al. | 292/216 |
| 2004/0155472 | A1 * | 8/2004 | Barr et al. | 292/336.3 |
| 2007/0029835 | A1 | 2/2007 | Herline et al. | |
| 2007/0069525 | A1 | 3/2007 | Ghannam | |
| 2008/0185850 | A1 * | 8/2008 | Takaya et al. | 70/237 |
| 2008/0277947 | A1 * | 11/2008 | Costigan | 292/336.3 |

* cited by examiner

*Primary Examiner* — Christopher Boswell
(74) *Attorney, Agent, or Firm* — Silicon Valley Patent Group LLP

(57) ABSTRACT

A door lock mechanism 100 comprises a door handle 110 including a turning grip part 110A, an open rod 120 which engages with the turning of the grip part 110A and opens a door by moving in a first direction, a key rod 140 which is linked to a key cylinder 115 and locks the door by moving in a second direction, a first engaging part 150 which is attached to open rod 120 and protrudes in a direction which intersects a movement direction of open rod 120, a second engaging part 160 which is attached to key rod 140 and protrudes in a direction which intersects a movement direction of key rod 140, and a displacement restricting part 170 which is fixed to the vehicle body and positioned further to the inside of the vehicle than first engaging part 150 and second engaging part 160.

4 Claims, 7 Drawing Sheets

SECTION B-B

SECTION C-C

DOOR LOCK MECHANISM

CROSS-REFERENCE TO RELATED APPLICATIONS

This application is based upon and claims the benefit of priority from the prior Japanese Patent Application No. 2009-257610, filed on Nov. 11, 2009, the entire contents of which are incorporated herein by reference.

BACKGROUND OF THE INVENTION

1. Field of the Invention

The present invention relates to a door lock mechanism in which a door is opened by a door handle and locked by a key cylinder.

2. Background of the Invention

When a vehicle receives an impact from the side (called a side surface impact or side impact), opening or locking a door caused by the impact should be avoided.

Patent document 1 (Japanese Laid Open Patent No. S60-55672) discloses, for example, a protrusion part arranged on the inner side of a door outer panel, as a prior art for preventing a door from opening at the time of a side impact. According to this document, when the door outer panel is deformed towards the inside of the vehicle at the time of a side impact, the protrusion part arranged on the outer panel also moves, engages with an extension part of unlock lever (lift lever) of a door lock device, and thereby prevents unlocking.

Patent document 2 (Japanese Patent No, 4099745) discloses, for example, a bracket arranged immediately next to a door latch connected with a key rod linked to a key cylinder, as a prior art for door lock prevention at the time of a side impact. This bracket is attached to a latch cover or a door outer panel. According to this document, the bracket is deformed by the impact, thereby interposes the key rod and prevents the key rod from moving to a locked state.

SUMMARY

However, according to the prior art described above, it is necessary to arrange a means for door opening prevention at the time of a side impact and another means for door lock prevention at the time of a side impact. It increases the number of manufacturing processes and number of components when installing the both means.

The present invention attempts to solve those problems by providing a simple door lock mechanism which prevents door opening and door locking at the time of a side impact.

In order to solve the above described problems a representative structure of a door lock mechanism according to the present invention comprises a door handle including a turning grip part, an open rod which engages with the turning of the grip part and opens a door by moving in a first direction, a key rod which is linked to a key cylinder and locks the door by moving in a second direction, a first engaging part which is attached to said open rod and protrudes in a direction which intersects a movement direction of said open rod, a second engaging part which is attached to said key rod and protrudes in a direction which intersects a movement direction of said key rod, and a displacement restricting part which is fixed to the vehicle body and positioned further to the inside of the vehicle than said first engaging part and second engaging part, wherein said displacement restricting part has a shape which interposes said first engaging part and said second engaging part when said open rod and said key rod move towards the inside of the vehicle and further move in the first direction and the second direction respectively.

According to the above described structure, when a side impact occurs and make the impact load act on the door from the side, even if said open rod and key rod move towards the inside of the vehicle and further move in the first direction and the second direction respectively, one common displacement restricting part interposes said first engaging part and said second engaging part. In this way, the movement of said open rod and key rod is restricted and a door is not opened or locked at the time of the side impact.

According to the present invention, it is not necessary to arrange separate means for separately restricting the displacement of each rod, and it is possible to restrict the displacement of both rods with one common displacement restricting part. Therefore, there is no significant increase in the number of components or manufacturing processes and it is possible to prevent a door opening and locking at the time of a side impact.

Said displacement restricting part described above may be attached to a vehicle door sash of the vehicle. Because the door sash is a window frame part which supports the door window glass and it is located in a position adjacent to both of said open rod and key rod, the door sash is favorable element to which a common displacement restricting member is attached. In addition, according to the invention, it is not necessary to attach a very small part for restricting displacement to a large part such as a door outer panel, as seen in a conventional manner. Therefore, said displacement restricting part may be positioned in consideration only of the position relative to said first engaging part and to said second engaging part. So, a process requiring a high level of accuracy when positioning said parts is not required.

Said second engaging part may overlap the door sash as seen from the side of the vehicle. With this structure, said second engaging part collides the door sash at the time of a side impact and thereby an excessive displacement of said key rod in a horizontal direction (towards the inside of the vehicle) is restricted. Otherwise, because the upper end of said key rod is fixed to the key cylinder, if the key rod moves excessively in a horizontal direction, the key rod bends and the part below the point where the bend occurs is pulled in an upwards direction to result in locking.

In order to solve the above described problems, another representative structure of the door lock mechanism according to the present invention comprises a door handle including a turning grip part, an open rod which engages with the turning of the grip part and opens a door by moving in a first direction, a key rod which is linked to a key cylinder and locks a door by moving in a second direction, wherein said open rod has a first crank part, said key rod has a second crank part, and wherein the door lock mechanism further comprises a displacement restricting part fixed to the vehicle body and positioned further to the inside of the vehicle than said first crank part and second crank part, said displacement restricting part having a shape which interposes said first crank part and said second crank part when said open rod and said key rod move towards the inside of the vehicle and further move in the first direction and the second direction respectively.

According to the above described structure, when a side impact occurs, even if said open rod and key rod move towards the inside of the vehicle and further move in the first direction and the second direction respectively, one common displacement restricting part interposes said first crank part and second crank part. In this way, the movement of said open rod and key rod is restricted and a door is not opened or locked at the time of the side impact.

Even with the above described structure, because it is possible to restrict the displacement of both rods using one common displacement restricting part. Therefore, there is no significant increase in the number of components or manufacturing processes and it is possible to prevent a door opening and locking at the time of a side impact.

According to some embodiments of the invention, a door lock mechanism comprises a door handle including a turning grip part, an open rod which engages with the turning of the grip part and opens a door by moving in a first direction, a key rod which is linked to a key cylinder and locks the door by moving in a second direction, a first engaging part which is attached to said open rod and protrudes in a direction which intersects a movement direction of said open rod, a second engaging part which is attached to said key rod and protrudes in a direction which intersects a movement direction of said key rod, and a displacement restricting part which is fixed to the vehicle body and positioned further to the inside of the vehicle than said first engaging part and second engaging part, wherein said displacement restricting part has a shape which interposes said first engaging part and said second engaging part when said open rod and said key rod move towards the inside of the vehicle and further move in the first direction and the second direction respectively.

According to the structure described above, it is possible to provide a simple door lock mechanism which prevents a door opening and locking at the time of a side impact.

BRIEF DESCRIPTION OF THE DRAWINGS

Embodiments of the invention will be described, by way of example only, with reference to the drawings.

DETAILED DESCRIPTION OF THE INVENTION

The preferred embodiments of the present invention are explained in detail below with reference to the accompanying drawings. The dimensions, materials and other specific numerical values are simply for exemplifying easy understanding of the invention and do not limit the invention. Furthermore, in the description of the invention and drawings, overlapping explanations are omitted by attaching the same symbols to elements having essentially the same function or structure and elements which are not directly related to the present invention are omitted from the drawings.

First Embodiment

Figure 1A:
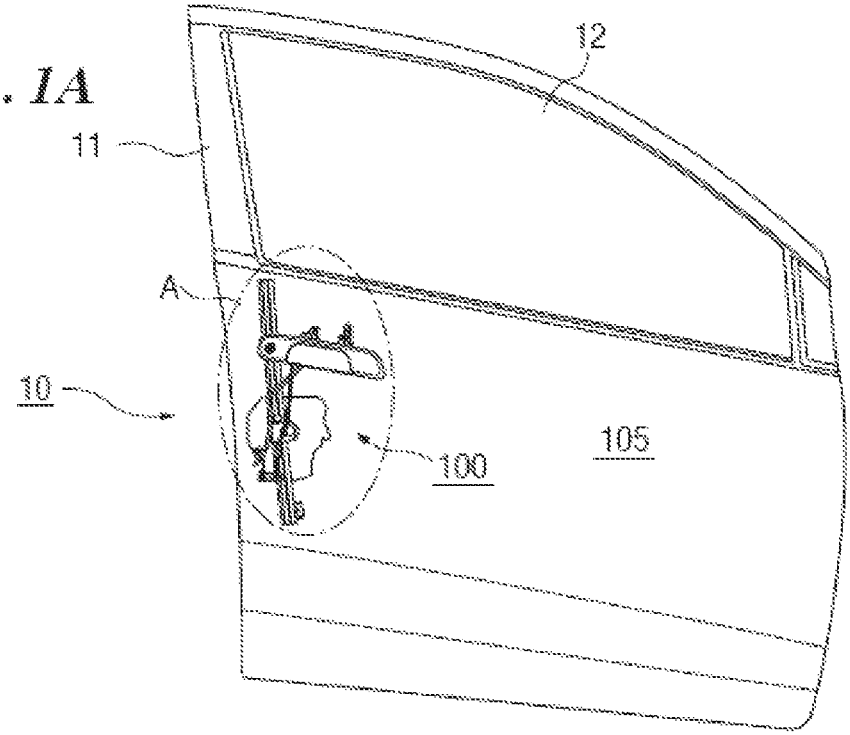
FIGS. 1A and 1B are diagrams which show a first embodiment of a door lock mechanism according to the present invention.
Figure 1B:
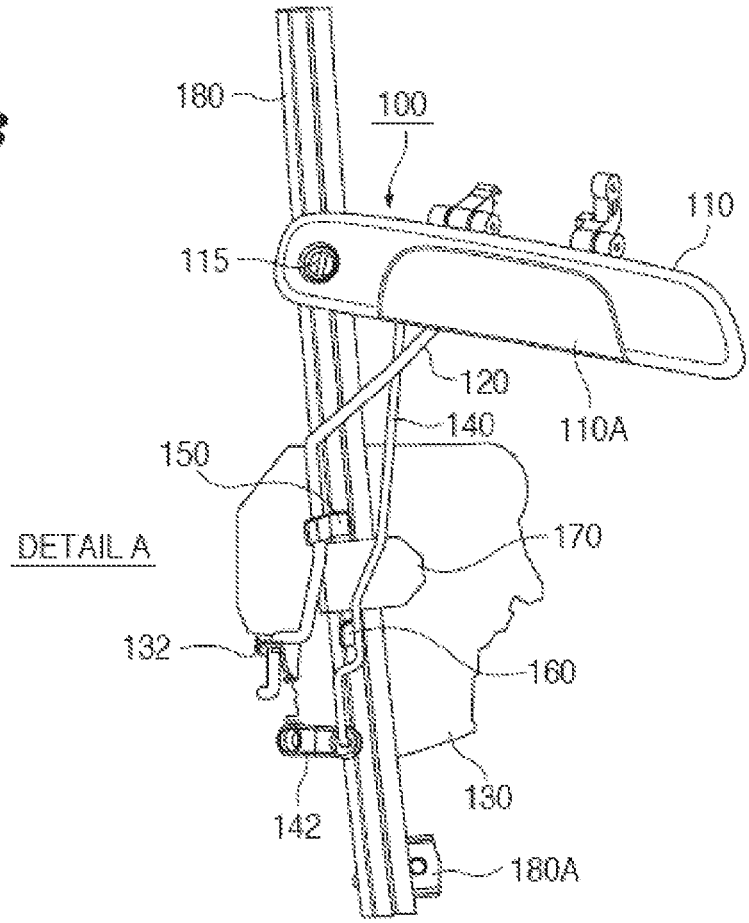

FIGS. 1A and 1B are diagrams which show a first embodiment of a door lock mechanism according to the present invention. FIG. 1A is a perspective view of a door outer panel 105 on the right side of the vehicle seen from the outside of the vehicle. The door lock mechanism 100 is provided with a door handle 110 which includes a turning grip part 110A. A key cylinder 115 is incorporated into the door handle 110. However, the key cylinder 115 may be arranged separately from the door handle 110 and may be attached to the door outer panel 105. Actually, when observed from the vehicle outside as is shown in FIG. 1A, components other than the door handle 110 do not appear to be hidden by the door outer panel 105.

The door lock mechanism 100 is provided with a rod shaped open rod 120, which opens the door 10 by engaging with the grip part 110A and moving in a first direction (downwards in the present embodiment). That is, the open rod 120 is arranged in a roughly up/down direction in order to pass between a door sash 180 described below and the door outer panel 105, and the top end part of the open rod 120 is positioned further forward of the vehicle than the door sash 180, is linked to the grip part 110A of the door handle 110 attached to the door outer panel 105, and the bottom end part of the open rod 120 is positioned further to the back of the vehicle than the door sash 180 and is linked to open lever 132 of the door latch 130. In addition, the door latch 130 opens the door 10 with a certain mechanism by the movement of the open rod 120 in a downwards direction.

The door lock mechanism 100 is provided with a rod shaped key rod 140, which moves with the turning of the a key (not shown in the diagram) which is inserted into the key cylinder 115, and locks the door 10 by movement in a second direction (upwards) which is opposite (approximately a reverse direction) a first direction (downwards). That is, the key rod 140 is arranged in a roughly up/down direction in order to pass between the door sash 180 described below and the door outer panel 105, and the top end part of the key rod 140 is positioned further forward of the vehicle than the door sash 180, is linked to the key cylinder 115, and the bottom end part of the key rod 140 is positioned further to the back of the vehicle than the door sash 180 and is linked to the lock lever 142 of the door latch 130. In addition, the lock lever 142 swings and the door latch 130 lock the door 10 with a certain mechanism by the movement of the key rod 140 in an upwards direction.

Furthermore, while the first direction and the second direction oppose each other in the present embodiment, they may also be the same direction. In addition, the movement direction is not limited to an up/down direction and the open rod 120 and key rod 140 may be structured to move in a left/right direction or other direction.

A first engaging part 150 and a second engaging part 160 are attached to the open rod 120 and key rod 140 respectively and project in a direction which intersects the movement direction of the open rod 120 and key rod 140. The first engaging part 150 and second engaging part 160 both have a plate shaped. Here, [a direction which intersects] also includes various directions which are at angles to the movement direction.

(Displacement Restricting Part)

Figure 2:
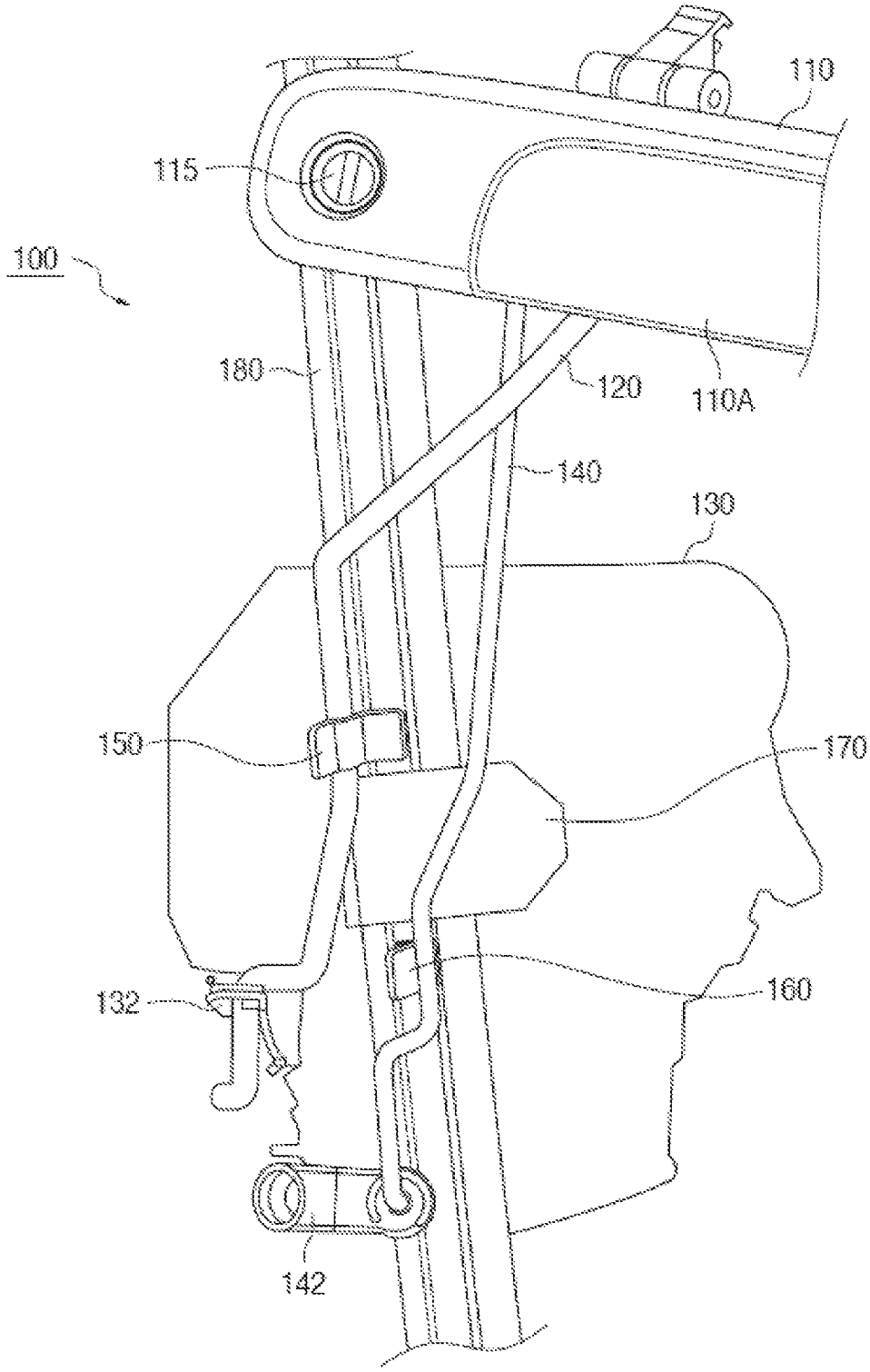
FIG. 2 is a partial enlarged diagram of FIGS. 1A and 1B.
Figure 3:
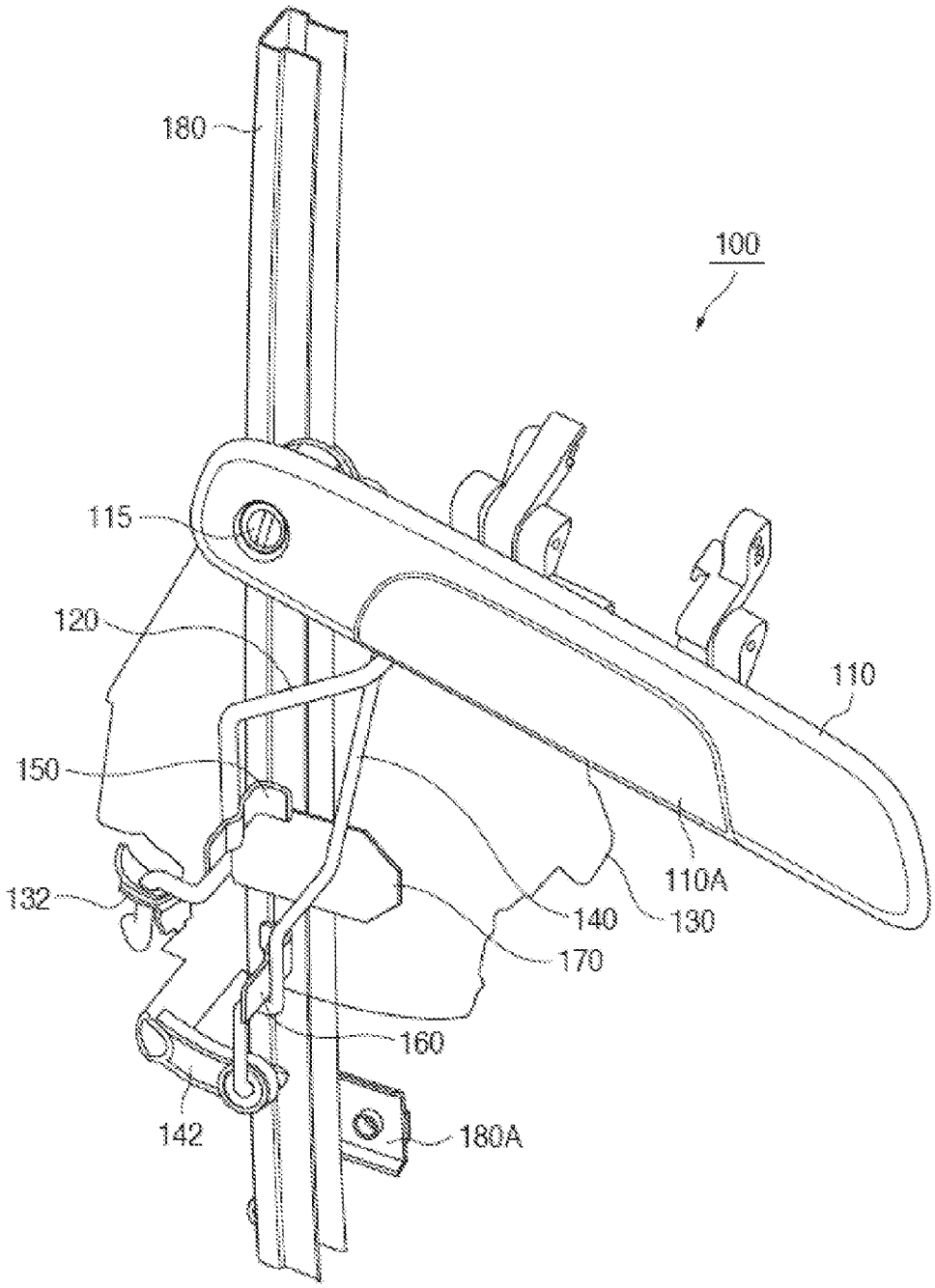
FIG. 3 is a perspective view of the door lock mechanisms in FIGS. 1A and 1B seen from slightly above.
Figure 4:
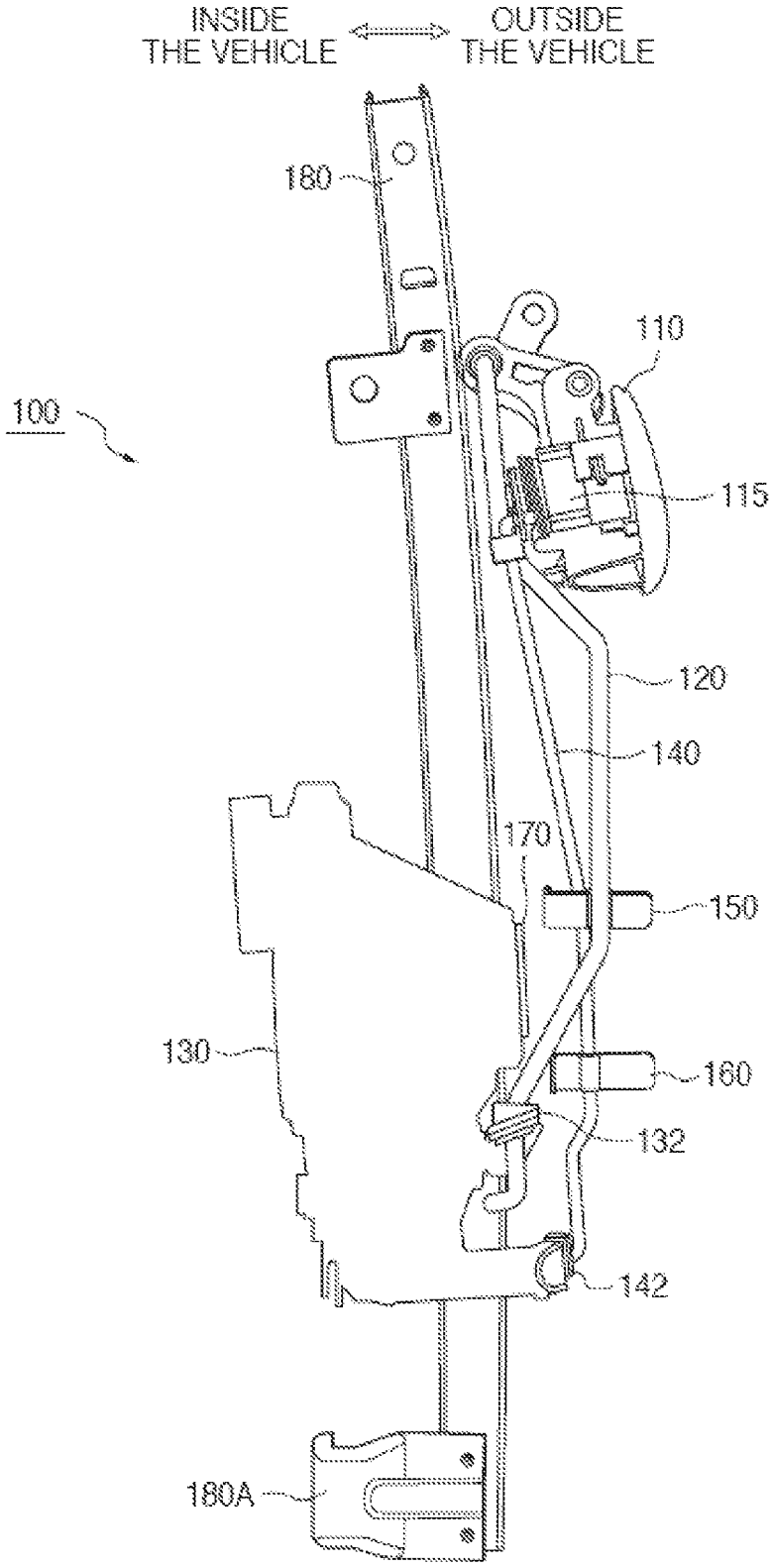
FIG. 4 is a rear view of the door lock mechanisms in FIGS. 1A and 1B seen from behind a vehicle.

FIG. 2 is a partial enlarged diagram of FIG. 1, FIG. 3 is a perspective view of the door lock mechanism 100 in FIG. 1 seen from slightly above and FIG. 4 is a rear view of the door lock mechanism 100 in FIG. 1 seen from behind a vehicle. The door lock mechanism 100 is further provided with a displacement restricting part 170. The displacement restricting part 170 also has a plate shape and is positioned between the first engaging part 150 and the second engaging part 160 in an up/down direction and slightly to the inside of the vehicle than the first engaging part 150 and the second engaging part 160, and is fixed to the chassis of the vehicle (door sash 180).

The displacement restricting part 170 is a metal plate having a roughly L shape, a cross section of the door sash 180 has a sideways U shape and one end of the displacement restricting part 170 is welded to a vehicle rear side surface of the door sash 180, and the other end projects towards to the door outer panel 105 and bends roughly parallel with a surface of the door sash 180 on the side of door outer panel 105. This other end is positioned at a height between the position of the first engaging part 150 in which the open rod 120 is in a position state which does not open the door, and the position of the second engaging part 160 in which the key rod 140 is in a position state which does not lock the door in an up/down direction of the vehicle, and is arranged roughly parallel with the direction of the door sash 180 maintaining a larger distance than the plate thickness of the first engaging part 150 and the second engaging part 160 with respect to the surface of the door sash 180 on the side of the door outer panel 105. In addition, the displacement restricting part 170 is usually arranged in a position with a space between the first engaging part 150 and the second engaging part 160 seen from the top of the vehicle, and because the first engaging part 150 and the second engaging part 160 pass through the door outer panel 105 side of the displacement restricting part 170, they do not come into contact and do not restrict the movement of the open rod 120 and the key rod 140.

Figure 5B:
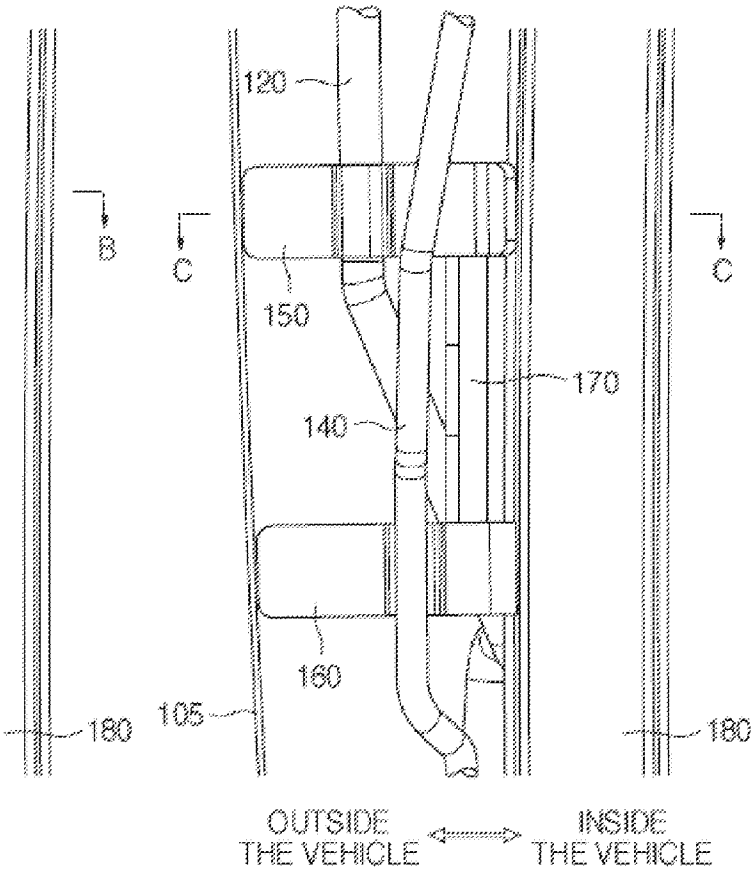
FIGS. 5A and 5B are enlarged front views of the door lock mechanisms in FIGS. 1A and 1B seen from the front of a vehicle.
Figure 5A:
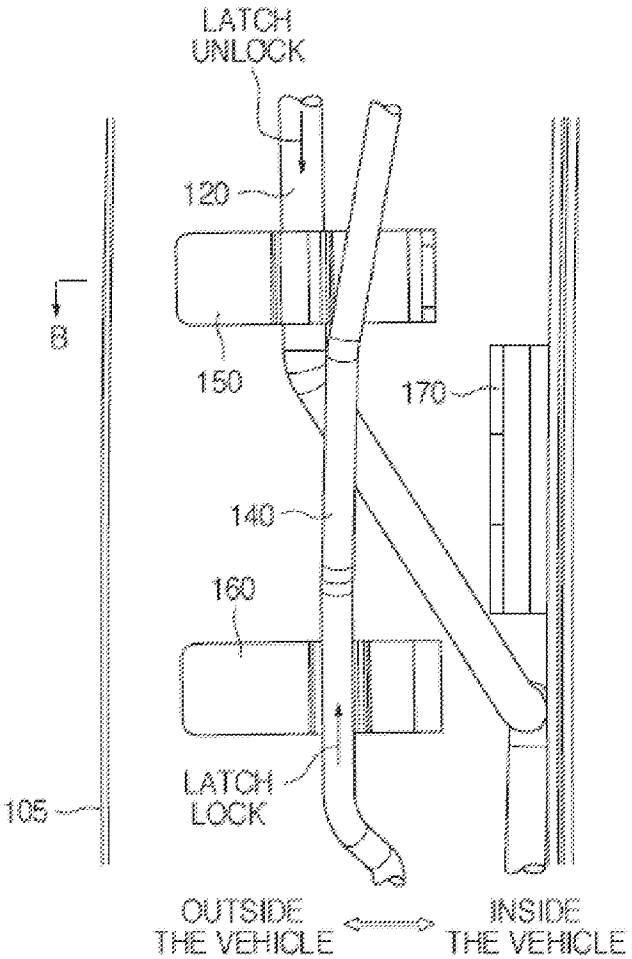
Figure 6A:
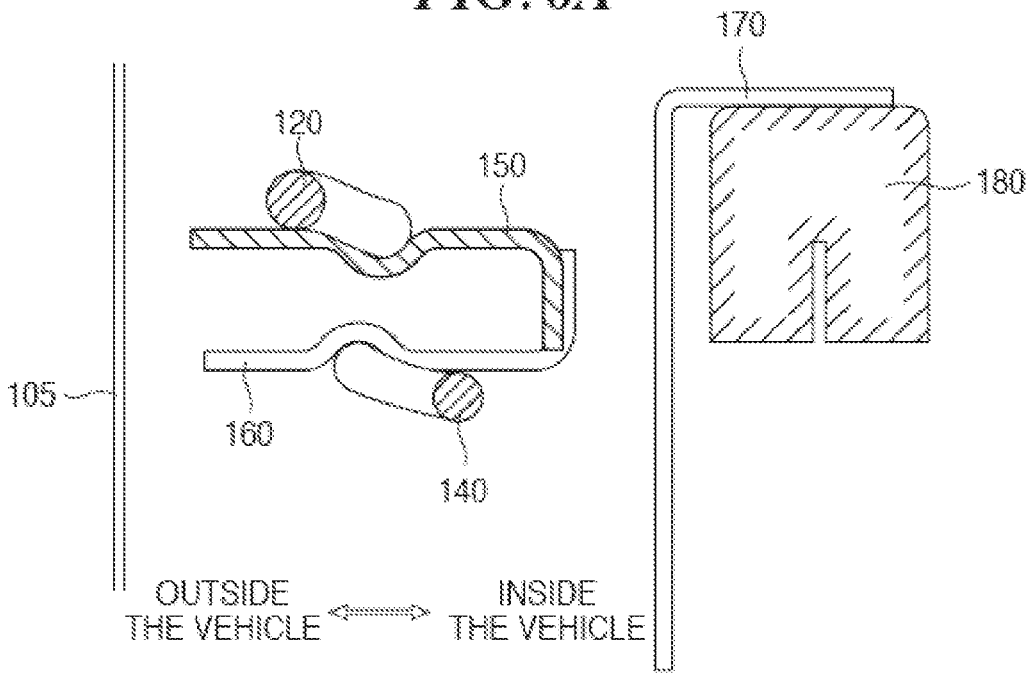
FIGS. 6A and 6B show each cross section of FIGS. 5A and 5B.
Figure 6B:
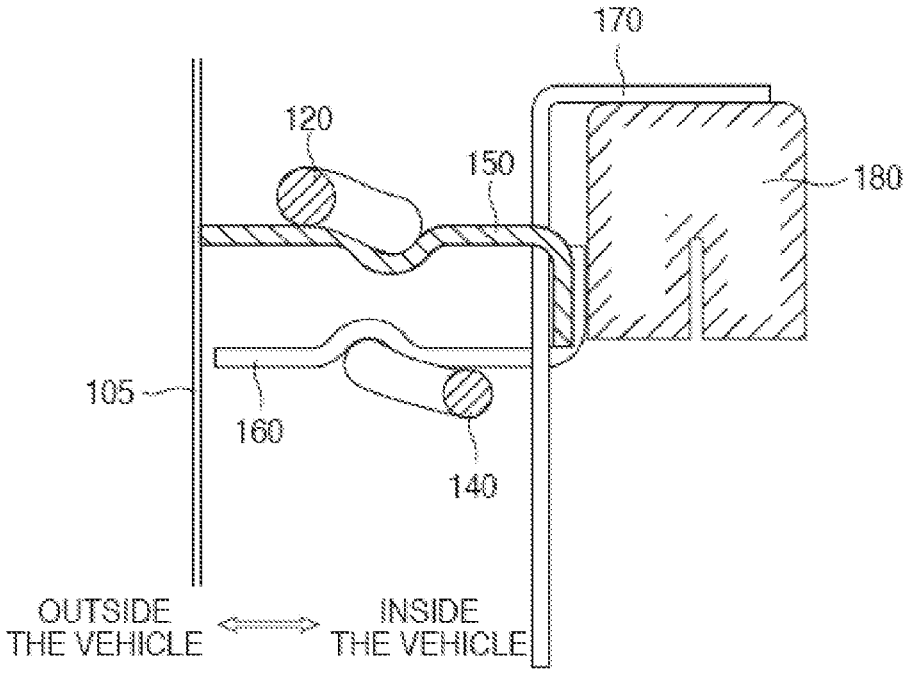

FIGS. 5A and 5B are enlarged front views of the door lock mechanism 100 in FIGS. 1A and 1B seen from the front of a vehicle, FIG. 5A shows a state before the door outer panel 105 receives a side surface collision, and FIG. 5B shows a state after the door outer panel 105 receives a side surface collision. FIGS. 6A and 6B show each cross section of FIGS. 5A and 5B, FIGS. 6A and 6B are cross sectional views of the lines B-B and C-C in FIGS. 5A and 5B. When the door of a vehicle receives a side surface collision, the first engaging part 150 and the second engaging part 160 are pushed by the transformed door outer panel 105. In this way, the open rod 120 and the key rod 140 move towards the inside of the vehicle as is shown in FIG. 5B and FIG. 6B from the state shown in FIG. 5A and FIG. 6A.

When this occurs, the end parts of the first engaging part 150 and the second engaging part 160 on the vehicle inside move to an upper position and a lower position of the displacement restricting part 170 respectively. In this state, the open rod 120 and the key rod 140 sometimes moves in a downwards and upwards direction respectively. That is, the grip part 110A of the door handle 110 swings due to the impact of the side surface collision and the open rod 120 sometimes attempts to displace in a downwards direction (door latch release direction). In addition, the door outer panel 105 is transformed by the impact of a side surface collision which increases the linking distance between the key cylinder 115 and the lock lever 142 of the door latch 130, the key rod 140 is pulled and sometimes displaces in an upwards direction (direction in which the door latch is in a locked state). At this time, as is shown in FIG. 6B, the displacement restricting part 170 is in a position which interposes between the first engaging part 150 and the second engaging part 160, and has a shape which interposes between the first engaging part 150 and the second engaging part 160 which are moving in an up/down direction.

As is shown in FIGS. 5A and 5B and FIGS. 6A and 6B, a part which is roughly parallel to the door sash 180 is formed on the open rod 120 and the key rod 140 respectively, and the first engaging part 150 and the second engaging part 160 are welded to this part. The first engaging part 150 and the second engaging part 160 are metal plates having a roughly L shape and one end of both parts projects towards the door outer panel 105 from the open rod 120. One end of both the first engaging part 150 and the second engaging part 160 is arranged near the door outer panel 105 at equal intervals from the door outer panel 105. As is shown in FIG. 6B this projection shape contacts with the door outer panel 105 at the time of a side surface collision, and it is possible to move the first engaging part 150 and second engaging part 160 towards the inside of the vehicle by quickly using the action of the transformed shape of the door outer panel 105.

The other end of the first engaging part 150 and the second engaging part 160 project towards the door sash 180 from the open rod 120 respectively, and bend roughly parallel to the door sash 180. This bent other end is arranged close to the side of the door sash 180, however, compared to the displacement restricting 170 maintains a large equal distance from the door sash 180. The other end of the first engaging part 150 and the second engaging part 160, as is shown in FIG. 6B, move to a position which interposes (overlaps) with the displacement restricting part 17 seen form the top of the vehicle by the movement of the first engaging part 150 and the second engaging part 160 to the inside of the vehicle, and becomes the part which contacts with the displacement restricting part 170 by a subsequent in an up/down direction.

As is shown in FIGS. 6A and 6B, the displacement restricting part 170 is also a metal plate having a roughly L shape. One end of the displacement restricting part 170 is welded to a vehicle rear side surface of the door sash 180 which has a cross section sideways U shape. The displacement restricting part 170 extends towards the door outer panel 105 from one welded end and extends further bending roughly parallel to the side surface of the door sash 180 on the door outer panel 105 side. This other end of the extending displacement restricting part 170 is positioned at a height between the position of the first engaging part 150 in which the open rod 120 is in a position state which does not open the door, and the position of the second engaging part 160 in which the key rod 140 is in a position state which does not lock the door in an up/down direction of the vehicle. The other end of the displacement restricting part 170 is arranged roughly parallel with the direction of the door sash 180 maintaining a larger distance than the plate thickness of the first engaging part 150 and the second engaging part 160 with respect to the surface of the door sash 180 on the side of the door outer panel 105.

As is shown in FIG. 6A, the displacement restricting part 170 is usually arranged in a position with an interval seen from the top of the vehicle with respect to the first engaging part 150 and the second engaging part 160. Therefore, because the first engaging part 150 and the second engaging part 160 pass through the door outer panel 105 side of the displacement restricting part 170, the first engaging part 150 and the second engaging part 160 do not come into contact and do not obstruct the movement of the open rod 120 and the key rod 140.

If the interposing conditions described above are met the displacement restricting part 170, the first engaging part 150 and the second engaging part 160 may each have shapes different to that in the present embodiment.

With the above described structure, when a side impact occurs, even if the open rod 120 and the key rod 140 move towards the inside of the vehicle, and subsequently move in a downwards and upwards direction, one common displacement restricting part 170 interposes the first engaging part 150 and the second engaging part 160 as is shown in FIG. 6B.

In this way, the movement of the open rod 120 and the key rod 140 is restricted and the door 10 is not opened or locked at the time of a side impact.

According to the present embodiment, because it is possible to restrict the displacement of both rods using one common displacement restricting part 170, it is not necessary to arranged a means for restricting each of the rods 120, 140 separately, there is no significant increase in the number of components or manufacturing processes and it is possible to prevent a door opening and locking at the time of a side impact.

Furthermore, it is preferred that the position where the first engaging part 150 and the second engaging part 160 are attached to each rod 120, 140 be on a straight line which connects the linking points (grip part 110 A side of the door handle and open lever 132 side of the door latch, and key cylinder 115 side and lock lever 141 side of the door latch) of each rod 120, 140 seen from the side of the vehicle. The reason for this is for preventing a rotation moment from occurring around the straight line which connects each rod's linking point in each rod due to the impact of a side surface collision and for preventing a misalignment of the positional relationship between the displacement restricting part 170 of the first engaging part 150 and second engaging part 160 and the door sash 180 due to the rotation displacement of each rod.

(Door Sash)

In the present embodiment, the displacement restricting part 170 is attached to the door sash 180 of a vehicle. The door sash 180 is a window frame part which supports the window glass of the door 10, is formed in a cross section roughly sideways U shape, a glassrun is set in the inside forming a guide groove for the window glass to move up and down. Because this door sash 180 is in a position near both the open rod 120 and the key rod 140, it is advantageous to attach a common displacement restricting part 170.

In addition, as in the conventional example, it is not necessary to attach a very small part for restricting displacement to a large part such as a door outer panel. Therefore, the displacement restricting part 170 may be attached while only considering the relative positional relationship between the first engaging part 150 and the second engaging part 160 and a process requiring a high level of accuracy when positioning the parts is not required.

Furthermore, as long as the displacement restricting part 170 interposes both the first engaging part 150 and the second engaging part 160, the displacement restricting part 170 can be arranged anywhere on the door sash 180 which improves freedom of layout design. By adjusting the shape of the open rod 120 and the key rod 140, the shape of the first engaging part 150 and the second engaging part 160, the attachment position on each rod, the shape of the displacement restricting part 170 and the attachment position on the door sash 180, it is possible to optimize the layout.

The door 10 has a structure in which a periphery edge part between the door outer panel 105 and a door inner panel (not shown in the diagram) is joined and a space is formed inside the door. In addition, a lower edge part the window 12 of the door 10 allows the window glass to move up and down within the door due to an aperture between the door outer panel 105 and the door inner panel.

The top side of the door sash 180 is fixed to an engaging part (not shown in the diagram) which is arranged on a reinforced part which forms the window frame 11 of the door 10 by inserting the top end part from the bottom. The bottom side of the door sash 180 is fixed by tightening a support part 180A with a bolt to the door inner panel from the inside of the vehicle.

Furthermore, while the door sash 180 is considered to be the most advantageous for attaching the displacement restricting part, this does not exclude attaching the displacement restricting part 170 on other parts of a vehicle.

(Key Rod, Second Engaging Part)

In the present embodiment, the second engaging part 160 overlaps with the door sash 180 seen from the side of the vehicle, that is, seen from the left in FIGS. 6A and 6B (outside of the vehicle). With this structure, the second engaging part 160 impacts the door sash 180 at the time of a side surface collision which restricts excessive displacement of the key rod 140 in a horizontal direction (inside of the vehicle). That is, the key rod 140 does not move further to the right than the position in FIG. 6B at the time of a side surface collision. When the key rod 140 moves excessively in a horizontal direction, because the top end is fixed to the key cylinder (not shown in the diagram), the key rod 140 bends, and the bottom part is pulled upwards from the point when the bend occurs which locks the door. Furthermore, because the bottom of the open rod 120 is in a latch release direction and is not restricted from being pulled upwards, this kind of layout is not necessary.

Second Embodiment

Figure 7B:
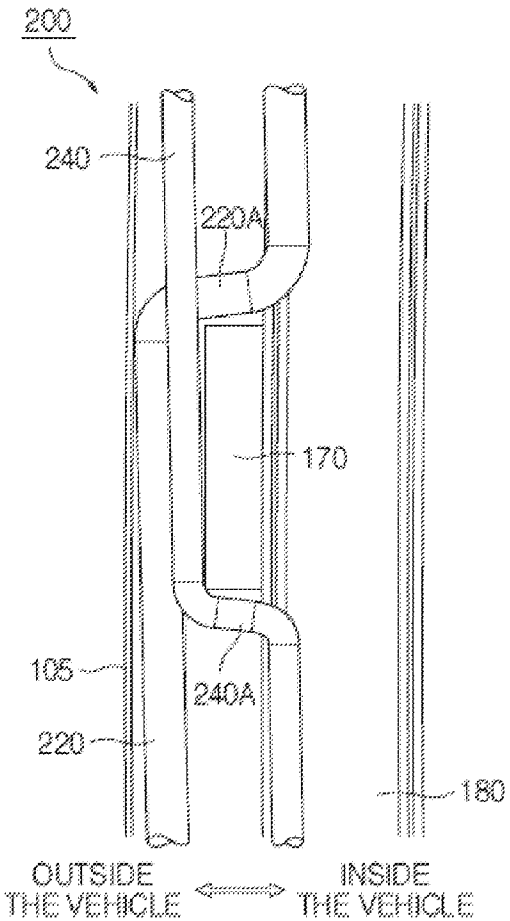
FIGS. 7A and 7B are diagrams which show a second embodiment of a door lock mechanism according to the present invention.
Figure 7A:
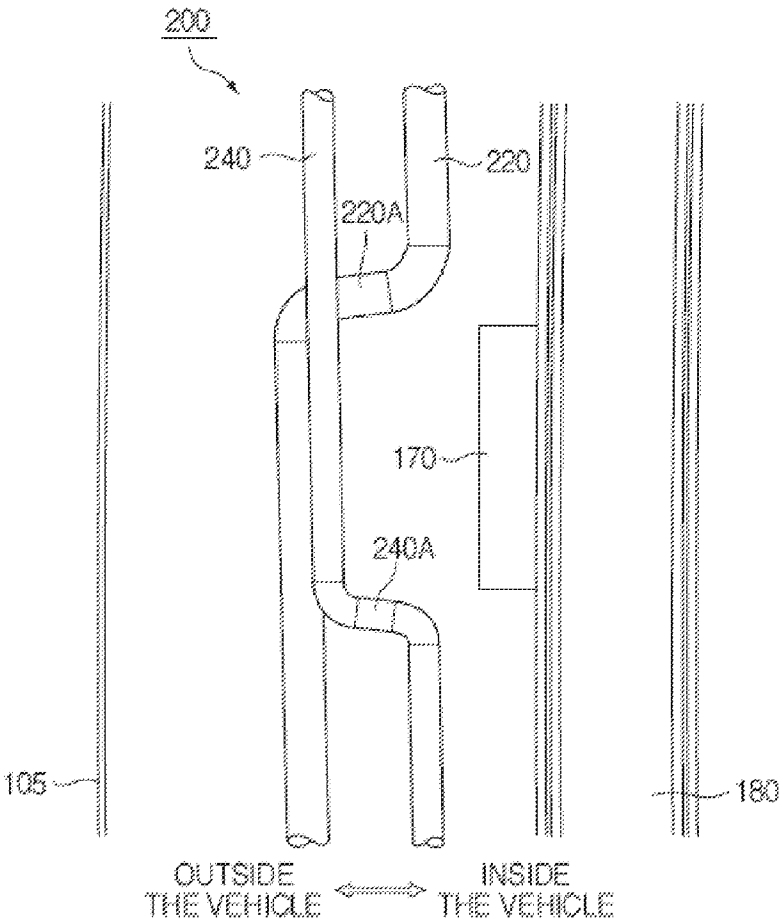

FIGS. 7A and 7B are diagrams which show a second embodiment of a door lock mechanism according to the present invention. In the present embodiment, only the points which are different to the first embodiment with respect to the door lock mechanism 200 will be explained below. The open rod 220 in the present embodiment includes a first crank part 220A and the key rod 240 includes a second crank 240A.

FIGS. 7A and 7B show the state before the door outer panel 105 received a side surface collision and the state after the door outer panel 105 receives a side surface collision. In the present embodiment, the displacement restricting part 170 is positioned between first crank part 220A and second crank 240A and more to the inside of the vehicle than the first crank part 220A and second crank 240A and is fixed to the vehicle chassis (door sash 180). When the open rod 22 and the key rod 240 receive a side surface collision, they are pushed by the deformed door outer panel 105 and as is shown in FIG. 7B move towards the inside of the vehicle from the state shown in FIG. 7A. In this way, the first crank 220A and the second crank 240A move to an upper position and a lower position of the displacement restricting part 170. In this state, when the open rod 220 and the key rod 240 move in a first direction (downwards) and a second direction (upwards) respectively, the displacement restricting part 170 is arranged in a position at which both the first crank part 220A and the second crank 240A interpose and includes an interposing shape.

With the above described structure, when a side impact occurs, even if the open rod 220 and the key rod 240 move towards the inside of the vehicle, and subsequently in a downwards and upwards direction respectively, one common displacement restricting part 170 interposes the first crank part 220A and the second crank part 240A as is shown in FIG. 7B. In this way, the same as in the first embodiment, the movement of the open rod 220 and the key rod 240 is restricted and the door 10 is not opened or locked at the time of a side impact.

Even with the above described structure, because it is possible to restrict displacement of both rods 220 and 240 by one common displacement restricting part 170, there is no significant increase in the number of components or manufacturing processes and it is possible to prevent a door opening and locking at the time of a side impact.

While the preferred embodiments of the present invention are explained above while referring to the diagrams, the present invention is not limited to these examples. It is clear that a person skilled in the art may make changes and modifications without departing from the scope of the appended claims and it is to be understood that such changes are within the technical scope of the present invention.

The present invention can be used in a door lock mechanism in which a door is opened with door handle and a door is locked with a key cylinder.

What is claimed is:

1. A door lock mechanism comprising:

a door handle including a turning grip part attached to the door outer panel;

a key cylinder which is incorporated into the door handle or is arranged separately from the door handle and attached to the door outer panel;

a door sash which is formed in a cross section roughly sideways U shape, fixed to the door inner panel and guides the window glass to move up and down;

an open rod which is arranged in a roughly up/down direction in order to pass between the door sash and the door outer panel, engages with the turning of the grip part and opens a door by moving in a first direction;

a key rod which is arranged in a roughly up/down direction in order to pass between the door sash and the door outer panel, the top end part of the key rod being linked to the key cylinder, the bottom end part of the key rod being linked to a door latch, and locks the door by moving in a second direction;

a first engaging part which is attached to said open rod and protrudes in a direction which intersects a movement direction of said open rod;

a second engaging part which is attached to said key rod and protrudes in a direction which intersects a movement direction of said key rod; and a displacement restricting part which is fixed to the door sash and positioned further to the inside of the vehicle than said first engaging part and second engaging part;

wherein said displacement restricting part has a shape which interposes said first engaging part and said second engaging part and restricts the movement of said open rod and said key rod respectively in the first direction and the second direction when said open rod and said key rod are pushed by the deformed door outer panel, move towards the inside of the vehicle and further move in the first direction and the second direction respectively.

2. The door lock mechanism according to claim 1, wherein the second direction is the upward direction, and said second engaging part overlaps the door sash as seen from the side of the vehicle.

3. The door lock mechanism according to claim 1, wherein one end of said first engaging part and second engaging part projects towards the door outer pane respectively from the open rod and from the key rod.

4. A door lock mechanism comprising:

a door handle including a turning grip part attached to the door outer panel;

a key cylinder which is incorporated into the door handle or is arranged separately from the door handle and attached to the door outer panel;

a door sash which is formed in a cross section roughly sideways U shape, fixed to the door inner panel and guides the window glass to move up and down;

an open rod which is arranged in a roughly up/down direction in order to pass between the door sash and the door outer panel, engages with the turning of the grip part and opens a door by moving in a first direction; and a key rod which is arranged in a roughly up/down direction in order to pass between the door sash and the door outer panel, the top end part of the key rod being linked to the key cylinder, the bottom end part of the key rod being linked to a door latch, and locks the door by moving in a second direction;

wherein said open rod has a first crank part, said key rod has a second crank part, and wherein the door lock mechanism further comprises a displacement restricting part which is fixed to the door sash and positioned further to the inside of the vehicle than the said first crank part and second crank part, said displacement restricting part having a shape which interposes said first crank part and said second crank part and restricts the movement of said open rod and said key rod respectively in the first direction and the second direction when said open rod and said key rod are pushed by the deformed door outer panel, move towards the inside of the vehicle and further move in the first direction and the second direction respectively.

* * * * *